US006508355B2

(12) United States Patent
Au et al.

(10) Patent No.: US 6,508,355 B2
(45) Date of Patent: Jan. 21, 2003

(54) JEWELRY BOX WITH SECURITY LOCKER

(75) Inventors: Kinsen Ka Fai Au, Hong Kong (CN); Kin Keung Chiu, Hong Kong (CN)

(73) Assignee: Nationalpak Limited, Hong Kong (CN)

( * ) Notice: Subject to any disclaimer, the term of this patent is extended or adjusted under 35 U.S.C. 154(b) by 0 days.

(21) Appl. No.: 09/755,544

(22) Filed: Jan. 5, 2001

(65) Prior Publication Data

US 2002/0088722 A1 Jul. 11, 2002

(51) Int. Cl.[7] ..... B65D 81/00
(52) U.S. Cl. ..... 206/6.1; 206/301; 206/807
(58) Field of Search ..... 206/1.5, 6.1, 301, 206/566, 807

(56) References Cited

U.S. PATENT DOCUMENTS 2,288,421 A * 6/1942 Rothbun ..... 206/6.1
4,511,041 A * 4/1985 Waltzman ..... 206/566
5,579,906 A * 12/1996 Fabbri et al. ..... 206/301
5,810,165 A * 9/1998 Lai ..... 206/301
5,873,457 A * 2/1999 Madweb ..... 206/301

* cited by examiner

*Primary Examiner*—Jim Foster
(74) *Attorney, Agent, or Firm*—Raymond Y. Chan; David & Raymond Patent Group

(57) ABSTRACT

A jewelry box includes a box body having a first side panel and a second side panel defined an inner cavity therebetween wherein a holding slot is provided in the inner cavity for holding a display in position, a ring-shaped supporting frame for rigidly supporting the display thereon detachably disposed in the holding slot, and a security locker including an elongated locking groove extended from the first side panel to the second side panel of the box body, an elongated locking member adapted for slidably inserting into the locking groove, which is penetrating through the supporting frame, and a stopper mounted on the locking groove for locking the locking member in the locking groove in a forward slidably movable manner, in such a manner that the display is securely locked up in the holding slot of the box body.

18 Claims, 4 Drawing Sheets

JEWELRY BOX WITH SECURITY LOCKER

BACKGROUND OF THE PRESENT INVENTION

1. Field of Invention

The present invention relates to a jewelry box, and more particularly to a jewelry box for watches, jewelry, and other displays with a security locker which can prevent the aforementioned objects from being removed from the jewelry box.

2. Description of Related Arts

Traditionally, a watch or an item of jewelry is held and displayed in a jewelry box. The watch or jewelry is inserted into a groove or onto a mount which is contained in the chamber of the jewelry box. A significant problem with the groove or the mount is that the watch or jewelry is frictionally held in the groove or on the mount. Furthermore. the groove and the mount are also only frictionally held in the chamber of the jewelry box. As a result, the watch or jewelry may easily come out of its box. Any force or vibration can dislodge the watch or jewelry from the box. Furthermore, an individual may easily shoplift the watch or jewelry by exerting a force on the watch or jewelry greater than the frictional force which holds the watch or jewelry in the box.

SUMMARY OF THE PRESENT INVENTION

A main object of the present invention is to provide a jewelry box for watches, jewelry and other displays with a security locker that can prevent the aforementioned objects from being removed from the jewelry box.

Another object of the present invention is to provide a jewelry box with a security locker which can be selectively positioned in an unlocked or a locked position. In the locked position, a holder is securely hold in a slot of the jewelry box such that the display cannot be accidentally taken out of the jewelry box.

Another object of the present invention is to provide a jewelry box with a security locker which is inconspicuous and cannot be seen in the front view of the jewelry box, such that the security locker does not disturb the aesthetic appearance of the jewelry box.

Another object of the present invention is to provide a jewelry box with a security locker that does not require to alter the original structural design of the jewelry box, so as to minimize the manufacturing cost of the jewelry box incorporating with the security locker.

Another object of the present invention is to provide a jewelry box with a security locker which is simple to use such that the displays are facilitated to securely attract to and detach from the jewelry box in the locked and unlocked position respectively.

Accordingly, in order to accomplish the above objects, the present invention provides a jewelry box. comprising:

- a box body having a first side panel and a second side panel defined an inner cavity therebetween wherein a holding slot is provided in the inner cavity for holding a display in position;
- a ring-shaped supporting frame for rigidly supporting the display thereon detachably disposed in the holding slot; and
- a security locker, comprising:
  - a pair of elongated locking grooves respectively formed through the first side panel and the second side panel of the box body;

- an elongated locking member adapted for slidably inserting through the locking grooves of the first and second side panels and the holding slot, and penetrating through the supporting frame in the holding slot in such a manner that the supporting frame is securely locked up in the holding slot of the box body; and
  - a stopper mounted on the locking groove for locking the locking member in the locking groove in a slidably movable manner.

DETAILED DESCRIPTION OF THE PREFERRED EMBODIMENT

Figure 1:
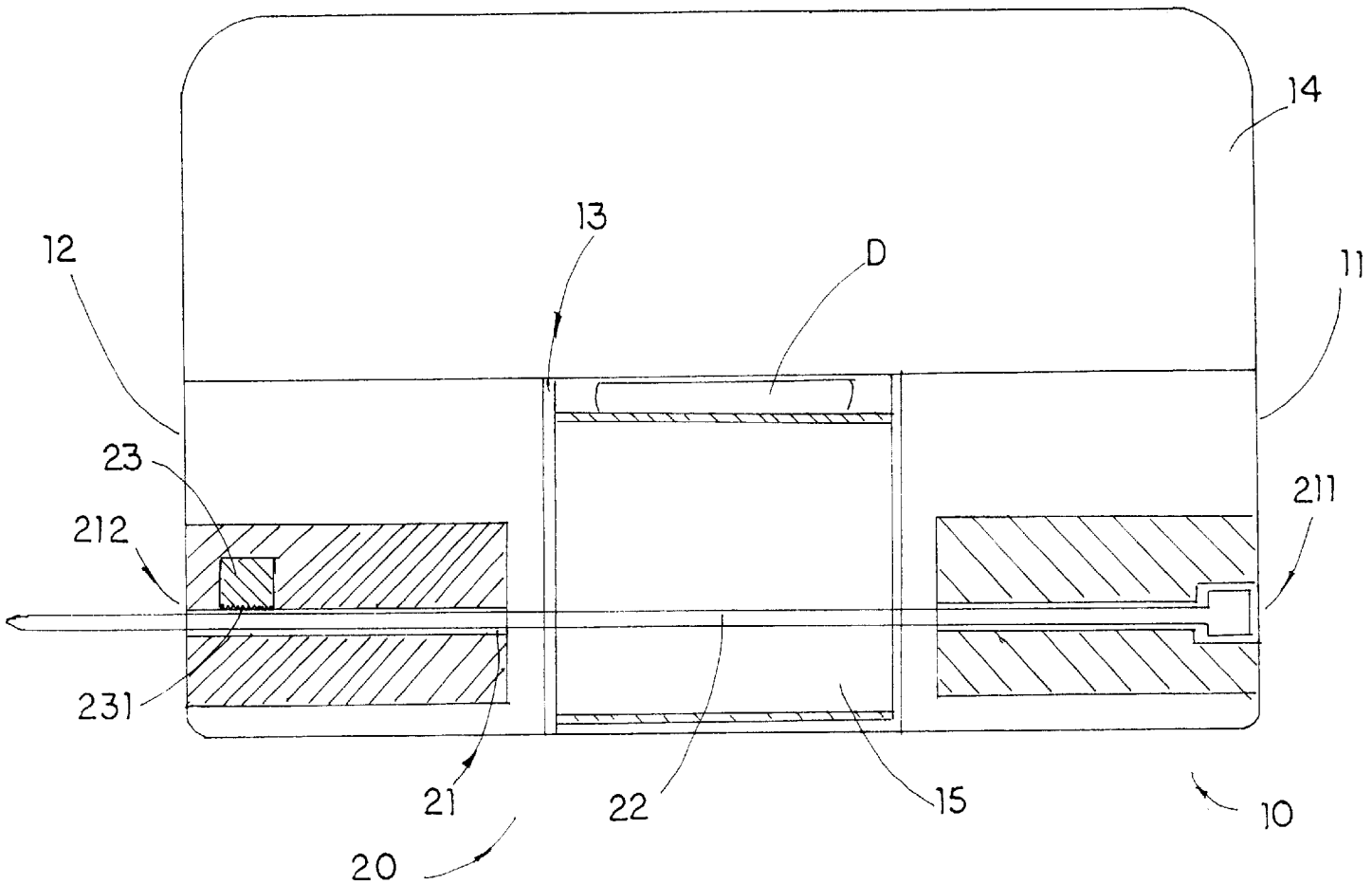
FIG. 1 is a sectional view of a jewelry box with security locker according, to a preferred embodiment of the present invention.

Referring to FIG. 1 of the drawings, a jewelry box with a security locker 20 according to a preferred embodiment of the present invention is illustrated, wherein the jewelry box, such as an ordinary jewelry box, is adapted for storing and displaying watches, jewelry, and other displays. The jewelry box, preferably having a rectangular shape according to the preferred embodiment, can be any size and shape such as circular or oval. The jewelry box can also be made of any material. However, the preferred material is plastic because of the ease and the low cost of construction. Thus, an artistic decoration such as metal plates or cushion stuffing can be mounted on the surfaces and/or inside of the jewelry box, so as to enhance the beauty appearance of the jewelry box.

Figure 6:
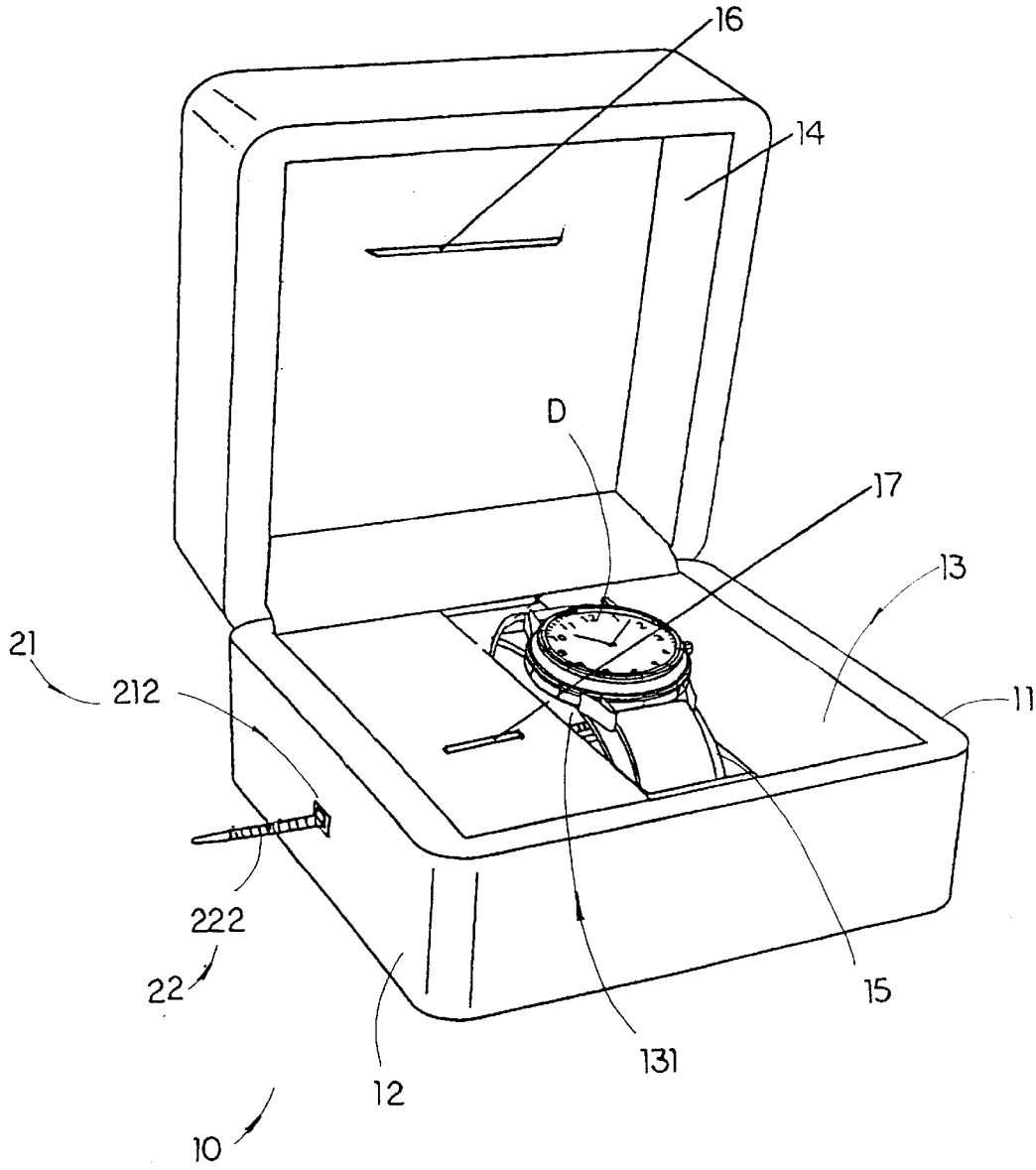
FIG. 6 is a perspective view of the jewelry box with security locker according to the above preferred embodiment of the present invention, illustrating a display mounted in the jewelry box.

The jewelry box comprises a box body 10 having a first side panel 11 and a second side panel 12 defined an inner cavity 13 therebetween wherein a holding slot 131 is provided in the inner cavity 13 for holding a display D in position, a cover 14 affixed on top of the box body 10 for opening and closing the inner cavity 13 of the box body 10, and a ring-shaped supporting frame 15 for rigidly supporting the display D thereon detachably disposed in the holding slot 131. The cover 14 can be detachably connected on top of the box body 10 so as to cover the inner cavity 13 and protect the display D inside the box body 10. Alternatively, the cover 13 can be pivotally connected to the box body 10 as shown in FIG. 6.

The security locker 20 comprises a pair of elongated locking grooves 21 respectively formed through the first side panel 11 and the second side panel 13 of the box body 10, an elongated locking member 22 adapted for slidably inserting through the locking grooves 21 of the first and second side panels 11, 12 and the holding slot 131, and penetrating through the supporting frame when the supporting frame 15 is mounted inside the holding slot 131 in such a manner that the supporting frame is securely locked up the display D in the holding slot 131 of the box body 10, and a stopper 23 mounted on the locking grooves 21 for locking the locking member 22 in the locking grooves 21 in a slidably movable manner.

Figure 2:
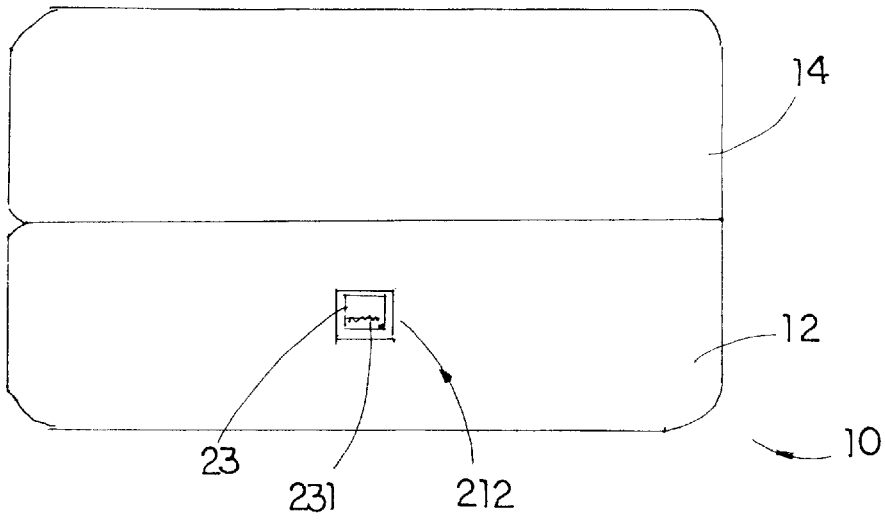
FIG. 2 is a left view of the jewelry box with security locker according to the above preferred embodiment of the present invention.
Figure 3:
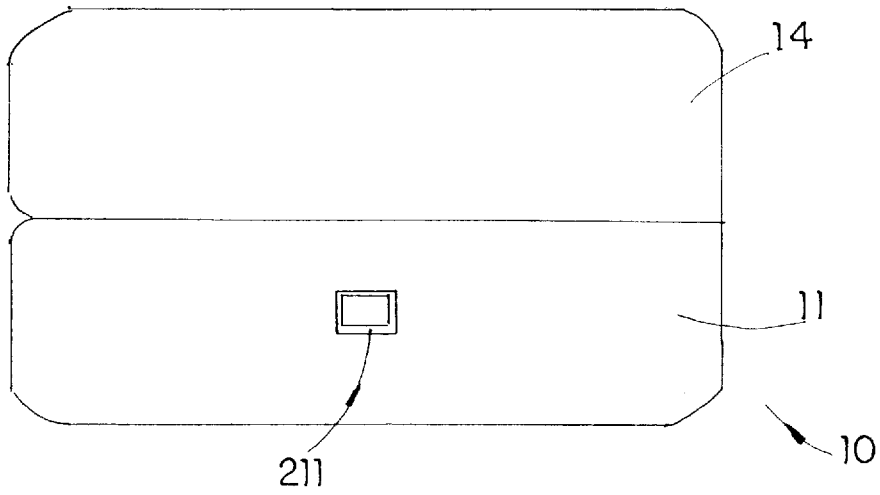
FIG. 3 is a right view of the jewelry box with security locker according to the above preferred embodiment of the present invention.

The first locking groove 21 comprises an inlet 211 provided on the first side panel 11 of the box body and the second locking groove 21 comprises an outlet 212 provided on the second side panel 12, as shown in FIGS. 2 and 3, wherein the inlet 211 and the outlet 212 are aligning with the supporting frame 15 when the supporting frame 15 is mounted in the inner cavity 13 in such a manner that the locking member 22 is adapted for slidably entering from the inlet 211 and exiting to the outlet 222 through the supporting frame 15.

Figure 4:
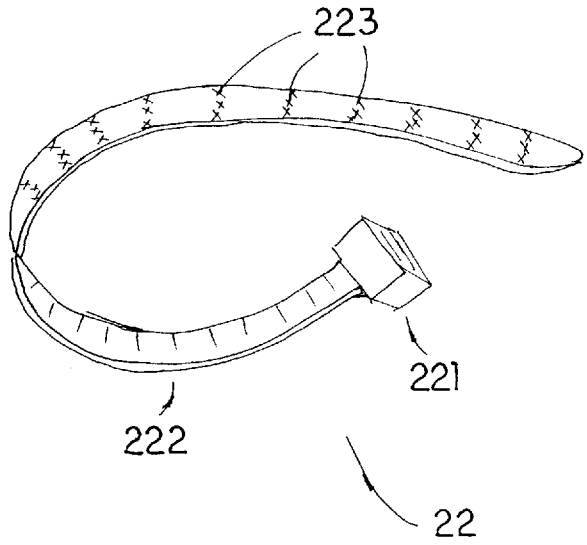
FIG. 4 is a perspective view of a locker means of the jewelry box with security locker according to the above preferred embodiment of the present invention.

Referring to FIG. 4, the locking member 22 has an enlarged head portion 221 and an elongated tail portion 222 wherein the locking member 22 has a length longer than a distance between the locking grooves 21 such that the locking member 22 is adapted to penetrate through the box body 10 from the first side panel 11 thereof to the second side panel 12, which is from the inlet 211 to outlet 212 of the locking grooves 21. The locking member 22 is a zip-tie made of durable plastic which is low cost for manufacturing.

Figure 5:
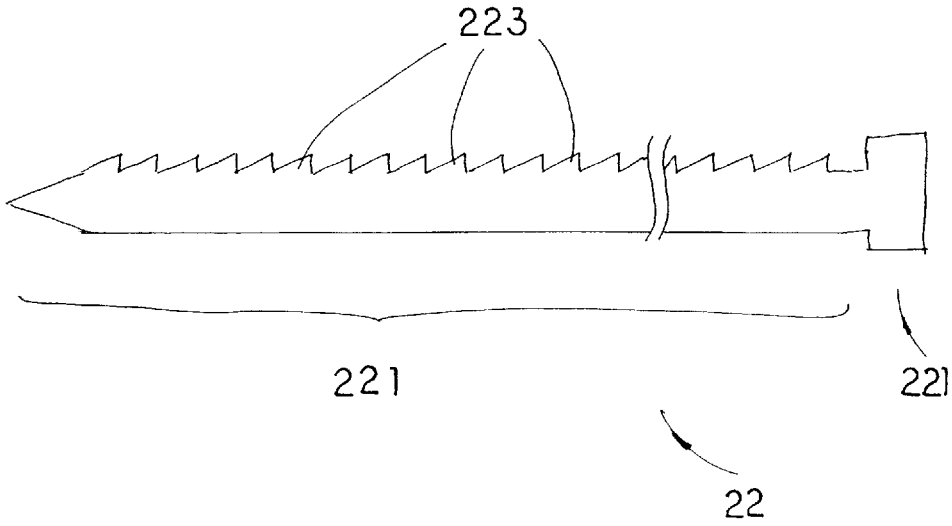
FIG. 5 is side view of the locker means of the jewelry box with security locker according to the above preferred embodiment of the present invention, illustrating a plurality of slanted teeth provided on the locker means.

Accordingly, the inlet 211 has an enlarged area with respect to the first locking groove 21 such that the head portion 221 of the locking member 22 is adapted for fittedly disposing in the inlet 211 of the first locking groove 21 when the locking member 22 is slidably inserted into the, as shown in FIG. 1. Thus, a plurality of slanted teeth 223 is evenly provided on at least one surface of the tail portion 222 of the locking member 22, as shown in FIG. 5, in such a manner that the locking member 22 is adapted for slidably inserting into the second locking groove 21 in a forward direction.

The stopper 23 is perpendicularly mounted on the second locking groove 21 near to the outlet 212 wherein the stopper 23 is adapted for engaging with the locking member 22, so as to lock up the locking member 22 in the locking groove 21. The stopper 23 comprises at least a locking tooth 231 provided on a bottom end thereof for fittedly engaging with the slanted teeth 223 of the locking member 22, so as to lock up the locking member 22 in the locking grooves 21 in such a reversed slidably movable manner. In other words, when the tail portion 222 of the locking member 22 is slidably passing from the inlet 211 to the outlet 212 in the forward direction, the locking member 22 cannot be pulled back from the inlet 211 in the reverse direction.

The jewelry box further comprises a pocket 16 provided in an interior of the cover 14 for storing an instruction manual of the display D or other advertisement, and a price tag mounting slot 17 mounted in the inner cavity 13 of the box body 10, so as to provide convenience for both the customer an the manufacturer.

In order to lock up the display D in the jewelry box, the display D is first mounted on the supporting frame 15 as usual and disposed in the holding slot 131 of the box body 10. Then the locking member 22 is slidably inserted through the locking grooves 21 from the inlet 211 to the outlet 212 and penetrating through the supporting frame 15 wherein the locking tooth 231 is automatically engaged with one of the slanted teeth 223 of the locking member 22, which will lock up the reversed direction of the locking member 22, so as to lock up the display D inside the box body 10.

For keeping the beauty appearance of the jewelry box, the tail portion 222 of the locking member 22, which is protruded from the outlet 212 of the second locking groove 21, can be cut such that the locking member 22 is inconspicuous for the box body 10, which will keep the neat appearance of the jewelry box so as to enhance the aesthetic characteristics of the display D.

In order to unlock the present invention, the user simply cut off the locking member 22 along the holding slot 131, the tail portion 221 of the second locking member 22 is then adapted for slidably pulling out from the outlet 212 of the locking groove 21 such that the supporting frame 15 can be detached from the box body 10 wherein the display D is mounted on the supporting frame 15.

Since the locking member 22 is a zip-tie which is durable, the locking member 22 can securely lock the supporting frame 15 in the box body 10 so as to prevent the display accidentally being taken out from the jewelry box. Thus, the locking process of the present invention is simple and quick. Simple insert the locking member 22 through the locking groove 21 and pull the tail portion 221 of the locking member 22 in the forward direction, the display D is then locked in the box body 10. Furthermore, the locking member 22 is in low cost and replaceable, so as to minimize the cost of the present invention with the maximum security of the display.

What is claimed is:

1. A jewelry box, which comprises:

a box body having a first side panel and a second side panel, wherein an inner cavity is provided between said first side panel and said second side panel and a holding slot is provided in said inner cavity for holding a display in position;

a ring-shaped supporting frame for rigidly supporting said display thereon detachably disposed in said holding slot; and a security locker, comprising:

first and second elongated locking grooves respectively formed through said first side panel and said second side panel of said box body;

an elongated locking member adapted for slidably inserting through said first and second locking grooves of said first and second side panels and said holding slot, and penetrating through said supporting frame in said holding slot in such a manner that said supporting frame is securely locked up in said holding slot of said box body, wherein said locking member, which comprises a plurality of slanted teeth evenly provided on at least one surface of said locking member, is adapted for slidably inserting through said first and second locking grooves in a forward direction; and a stopper mounted on said second locking groove for locking said locking member in said first and second locking grooves in a slidably movable manner, wherein said stopper has at least a locking tooth mounted on a bottom thereof for engaging with said slanted teeth of said locking member.

2. A jewelry box, as recited in claim 1, wherein said first locking groove comprises an inlet provided on said first side panel of said box body and said second locking groove comprises an outlet provided on said second side panel thereof, wherein said inlet and said outlet are aligning with said supporting frame when said supporting frame is mounted inside said holding slot in such a manner that said locking member is adapted for slidably entering from said inlet and exiting to said outlet through said supporting frame.

3. A jewelry box, as recited in claim 1, wherein said locking member has an enlarged head portion and an elongated tail portion wherein a plurality of slanted teeth is evenly provided on said tail portion of said locking member.

4. A jewelry box, as recited in claim 2, wherein said locking member has an enlarged head portion and an elongated tail portion wherein said slanted teeth are evenly provided on said tail portion of said locking member.

5. A jewelry box, as recited in claim 2, wherein said locking member is a zip-tie which is made of durable plastic.

6. A jewelry box, as recited in claim 3, wherein said locking member is a zip-tie which is made of durable plastic.

7. A jewelry box, as recited in claim 4, wherein said locking member is a zip-tie which is made of durable plastic.

8. A jewelry box, as recited in claim 4, wherein said inlet has an enlarged area with respect to said first locking groove such that said head portion of said locking member is adapted for fittedly disposing in said inlet of said first locking groove when said locking member is slidably inserted into said first locking groove.

9. A jewelry box, as recited in claim 7, wherein said inlet has an enlarged area with respect to said first locking groove such that said head portion of said locking member is adapted for fittedly disposing in said inlet of said first locking groove when said locking member is slidably inserted into said first locking groove.

10. A jewelry box, as recited in claim 7, wherein said stopper is perpendicularly mounted on said second locking groove near to said outlet for securely locking said tail portion of said locking member.

11. A jewelry box, as recited in claim 9, wherein said stopper is perpendicularly mounted on said second locking groove near to said outlet for securely locking said tail portion of said locking member.

12. A jewelry box, as recited in claim 7, further comprising a cover pivotally affixed on top of said box body.

13. A jewelry box, as recited in claim 11, further comprising a cover pivotally affixed on top of said box body.

14. A jewelry box, as recited in claim 7, further comprising a pocket provided in an interior of said cover for storing an instruction manual of said display and a price tag mounting slot mounted in said inner cavity of the box body.

15. A jewelry box, as recited in claim 9, further comprising a pocket provided in an interior of said cover for storing an instruction manual of said display and a price tag mounting slot mounted in said inner cavity of the box body.

16. A jewelry box, as recited in claim 13, further comprising a pocket provided in an interior of said cover for storing an instruction manual of said display and a price tag mounting slot mounted in said inner cavity of the box body.

17. A jewelry box, which comprises:

a box body having a first side panel and a second side panel, wherein an inner cavity is provided between said first side panel and said second side panel and a holding slot is provided in said inner cavity for holding a display in position;

a ring-shaped supporting frame for rigidly supporting said display thereon detachably disposed in said holding slot; and a security locker, comprising:

first and second elongated locking grooves respectively formed through said first side panel and said second side panel of said box body;

an elongated locking member adapted for slidably inserting through said first and second locking grooves of said first and second side panels and said holding slot, and penetrating through said supporting frame in said holding slot in such a manner that said supporting frame is securely locked up in said holding slot of said box body, wherein said locking member has an enlarged head portion and an elongated tail portion and a plurality of slanted teeth is evenly provided on said tail portion of said locking member; and a stopper mounted on said second locking groove for locking said locking member in said first and second locking grooves in a slidably movable manner.

18. A jewelry box, which comprises:

a box body having a first side panel and a second side panel, wherein an inner cavity is provided between said first side panel and said second side panel and a holding slot is provided in said inner cavity for holding a display in position;

a ring-shaped supporting frame for rigidly supporting said display thereon detachably disposed in said holding slot; and a security locker, comprising:

first and second elongated locking grooves respectively formed through said first side panel and said second side panel of said box body, wherein said first locking groove has an inlet provided on said first side panel of said box body and said second locking groove has an outlet provided on said second side panel thereof, wherein said inlet and said outlet are aligning with said supporting frame when said supporting frame is mounted inside said holding slot;

an elongated locking member adapted for slidably inserting through said first and second locking grooves of said first and second side panels and said holding slot, and penetrating through said supporting frame in said holding slot in such a manner that said supporting frame is securely locked up in said holding slot of said box body, wherein said locking member, which is adapted for slidably entering from said inlet and exiting to said outlet through said supporting frame, has an enlarged head portion and an elongated tail portion wherein a plurality of slanted teeth is evenly provided on said tail portion of said locking member; and a stopper mounted on said second locking groove for locking said locking member in said first and second locking grooves in a slidably movable manner.

* * * * *